US010527281B1

(12) United States Patent
Brannon

(10) Patent No.: US 10,527,281 B1
(45) Date of Patent: Jan. 7, 2020

(54) GAS FLARE USEFUL FOR COMBUSTING LANDFILL GAS EMISSIONS

(71) Applicant: Linwood Thad Brannon, Windermere, FL (US)

(72) Inventor: Linwood Thad Brannon, Windermere, FL (US)

( * ) Notice: Subject to any disclaimer, the term of this patent is extended or adjusted under 35 U.S.C. 154(b) by 525 days.

(21) Appl. No.: 15/285,224

(22) Filed: Oct. 4, 2016

Related U.S. Application Data

(60) Provisional application No. 62/237,215, filed on Oct. 5, 2015.

(51) Int. Cl.

| | |
|---|---|
| ***F23G 7/08*** | (2006.01) |
| ***F23D 14/28*** | (2006.01) |
| ***F23D 99/00*** | (2010.01) |
| ***F23K 5/00*** | (2006.01) |
| ***F23Q 3/00*** | (2006.01) |

(52) U.S. Cl.
CPC ..... *F23G 7/08* (2013.01); *F23D 14/28* (2013.01); *F23D 91/00* (2015.07); *F23K 5/002* (2013.01); *F23Q 3/00* (2013.01); *F23D 2203/00* (2013.01)

(58) Field of Classification Search
CPC .... F23G 7/08; F23G 7/085; F23G 5/00; F23L 17/02; F23L 17/12
See application file for complete search history.

(56) References Cited

U.S. PATENT DOCUMENTS

| | | | | | |
|---|---|---|---|---|---|
| 215,279 | A | * | 5/1879 | Moore | F23L 17/02 454/37 |
| 1,346,633 | A | * | 7/1920 | Cloud | F23L 17/02 454/37 |
| 1,426,815 | A | | 8/1922 | Mathias | |
| 1,728,494 | A | * | 9/1929 | Knutson | F24F 7/02 454/36 |
| 1,873,368 | A | * | 8/1932 | Filkins | F24F 7/02 454/31 |
| 2,802,521 | A | | 8/1957 | Campbell et al. | |
| 3,183,822 | A | * | 5/1965 | Stone | F23L 17/02 454/38 |
| 3,543,670 | A | * | 12/1970 | Stone | F23L 17/12 285/419 |
| 3,637,336 | A | | 1/1972 | Velie et al. | |
| 3,650,198 | A | * | 3/1972 | Stone | F16L 17/02 454/37 |

(Continued)

OTHER PUBLICATIONS

Lang, Sally; "Innovative Engineering With an Impact"; http://www.daa.com/author/sally-lang/; Nov. 18, 2015; pp. 1-11.

*Primary Examiner* — Jorge A Pereiro

(74) *Attorney, Agent, or Firm* — Christopher M. Ramsey; GrayRobinson, P.A.

(57) ABSTRACT

A gas flare apparatus includes a burner tube that receives combustible gas and includes (a) a burner tube outer perimeter defined by a burner tube outer diameter and (b) a burner tube inner perimeter defined by a burner tube inner diameter. An updraft shield is concentric with the burner tube and extends outwardly relative to the burner tube outer perimeter to an updraft shield outer perimeter. A windshield tube is concentric with the burner tube and has a windshield tube inner diameter that is larger than the burner tube outer diameter. The windshield tube is positioned above the updraft shield. A cover plate spaced apart from and covering an upper opening of the windshield tube.

18 Claims, 7 Drawing Sheets

(56) References Cited

U.S. PATENT DOCUMENTS

| | | | | | |
|---|---|---|---|---|---|
| 3,729,287 | A | | 4/1973 | Strashok | |
| 3,852,023 | A | * | 12/1974 | Itoh | F23G 7/08 431/202 |
| 4,082,497 | A | | 4/1978 | Crawford et al. | |
| 4,364,372 | A | | 12/1982 | Johnson | |
| 4,398,453 | A | * | 8/1983 | Wilkerson | F23L 17/12 138/155 |
| 4,907,964 | A | | 3/1990 | Howarth et al. | |
| 4,976,608 | A | | 12/1990 | Hyde | |
| 5,429,496 | A | | 7/1995 | Stephens et al. | |
| 5,823,759 | A | * | 10/1998 | Swithenbank | F23G 7/085 431/5 |
| 5,938,426 | A | * | 8/1999 | McGehee | F23Q 3/008 431/202 |
| 6,145,258 | A | * | 11/2000 | Barnoff | F23L 17/12 52/244 |
| 6,146,131 | A | * | 11/2000 | Wiseman | F23C 5/02 431/154 |
| 6,443,728 | B1 | | 9/2002 | Edberg et al. | |
| 6,702,572 | B2 | | 3/2004 | Hong et al. | |
| 7,458,888 | B2 | * | 12/2008 | Huta | F23L 17/02 454/36 |
| 2003/0044741 | A1 | * | 3/2003 | McGehee | F23Q 3/008 431/263 |
| 2006/0286497 | A1 | * | 12/2006 | Tursky | F23Q 9/00 431/278 |
| 2013/0143170 | A1 | * | 6/2013 | Krebber | F16K 3/03 431/202 |
| 2014/0170576 | A1 | * | 6/2014 | Colannino | F23C 99/001 431/253 |
| 2015/0104752 | A1 | * | 4/2015 | Lang | F23D 14/04 431/202 |

* cited by examiner

GAS FLARE USEFUL FOR COMBUSTING LANDFILL GAS EMISSIONS

CROSS-REFERENCE TO RELATED APPLICATION

This claims priority from U.S. provisional Application No. 62/237,215, filed Oct. 5, 2015, which is hereby incorporated by reference in its entirety.

FIELD

This relates to the field of gas combustion and, more particularly, to combustion of gases produced by landfills.

BACKGROUND

When organic waste present in a landfill decomposes, combustible gas is generated. This gas often has an unpleasant smell and typically includes methane, carbon dioxide, and other constituents, such as hydrogen sulfide and complex hydrocarbons. Landfill gas may cause severe odor problems.

Once landfills have reached full capacity, they are generally capped with among other things, a layer of topsoil to support vegetation and help prevent erosion. A gas vent is sometimes provided to enable the landfill gas generated by the decomposition process to pass through the cap for release.

The gas emerging from the vent may be burned to eliminate the unpleasant odor. A flare is typically provided to burn the gas as it emerges from the vent. While passive flares can be cost effective they routinely burn out. Several factors contribute to this difficulty, including variations in the flow rate of the gas, variations in the percentages of the constituents of the landfill gas, and variations in the gas/air ratio mixture required to maintain a continuous flame. Adverse weather conditions such as wind and precipitation may also extinguish the flame.

Because such passive flares are positioned proximate to the landfill vents to minimize the use of lengthy gas pipe runs, the flares are usually located in remote locations where it is difficult to monitor the presence of a flame. It is very inconvenient to manually re-ignite the flares when the flame is extinguished. During any time in which the flame is out, the gas is permitted to escape into the atmosphere, creating potentially lengthy periods in which the odor is not being treated.

Construction and demolition (C&D) landfills typically do not produce a lot of combustible gas because they do not contain as much organic content compared to Class 3 and Class 1 facilities that typically receive large quantities of organic waste. This means C&D landfills have relatively low gas combustible flow rates through their gas vents. Such a flow rate may be 0.5 CFM to 70 CFM (CFM=cubic feet per minute).

Because conventional gas flares are designed for landfills that contain large amounts of organic waste, they do not burn continuously in low gas flow conditions present at C&D landfills. At C&D landfills, conventional gas flares extinguish routinely because of low combustible gas flow.

In particular, conventional open air/open top/perforated flares are highly susceptible to wind and precipitation. Typical open top/open air/perforated flare allow for the dilution, disruption and dispersion of the landfill gas, preventing consistent combustion. They also allow the wind to direct the gas away from the ignition source. Such problems commonly occur when low combustible gas flow rates exist, which is a common condition at C&D landfills.

BRIEF SUMMARY

In view of the drawbacks of conventional landfill gas flares, there was a need to develop a gas flare that can maintain combustion of landfill gas when the flow rate of combustible gas is low, such as at a C&D landfill.

An example of such a gas flare includes a burner tube that receives combustible gas and includes (a) a burner tube outer perimeter defined by a burner tube outer diameter and (b) a burner tube inner perimeter defined by a burner tube inner diameter. An updraft shield is concentric with the burner tube and extends outwardly relative to the burner tube outer perimeter to an updraft shield outer perimeter. A windshield tube is concentric with the burner tube and has a windshield tube inner diameter that is larger than the burner tube outer diameter. The windshield tube is positioned above the updraft shield. A cover plate spaced apart from and covers an upper opening of the windshield tube.

An example of a method of combusting landfill gas using the gas flare apparatus includes operating the gas flare apparatus when it is positioned over a gas flow conduit that extends into a landfill storing decomposing waste that generates combustible gas.

An example of a method of constructing a gas flare includes attaching a cap to a burner tube that receives combustible gas and includes (a) a burner tube outer perimeter defined by a burner tube outer diameter and (b) a burner tube inner perimeter defined by a burner tube inner diameter. The cap includes a sleeve tube attachable to the burner tube. The sleeve tube has attached thereto: (a) a windshield tube concentric with the burner tube and having a windshield tube inner diameter that is larger than the burner tube outer diameter and (b) a cover plate spaced apart from and covering an upper opening of the windshield tube.

DETAILED DESCRIPTION OF EXAMPLE EMBODIMENTS

Figure 1:
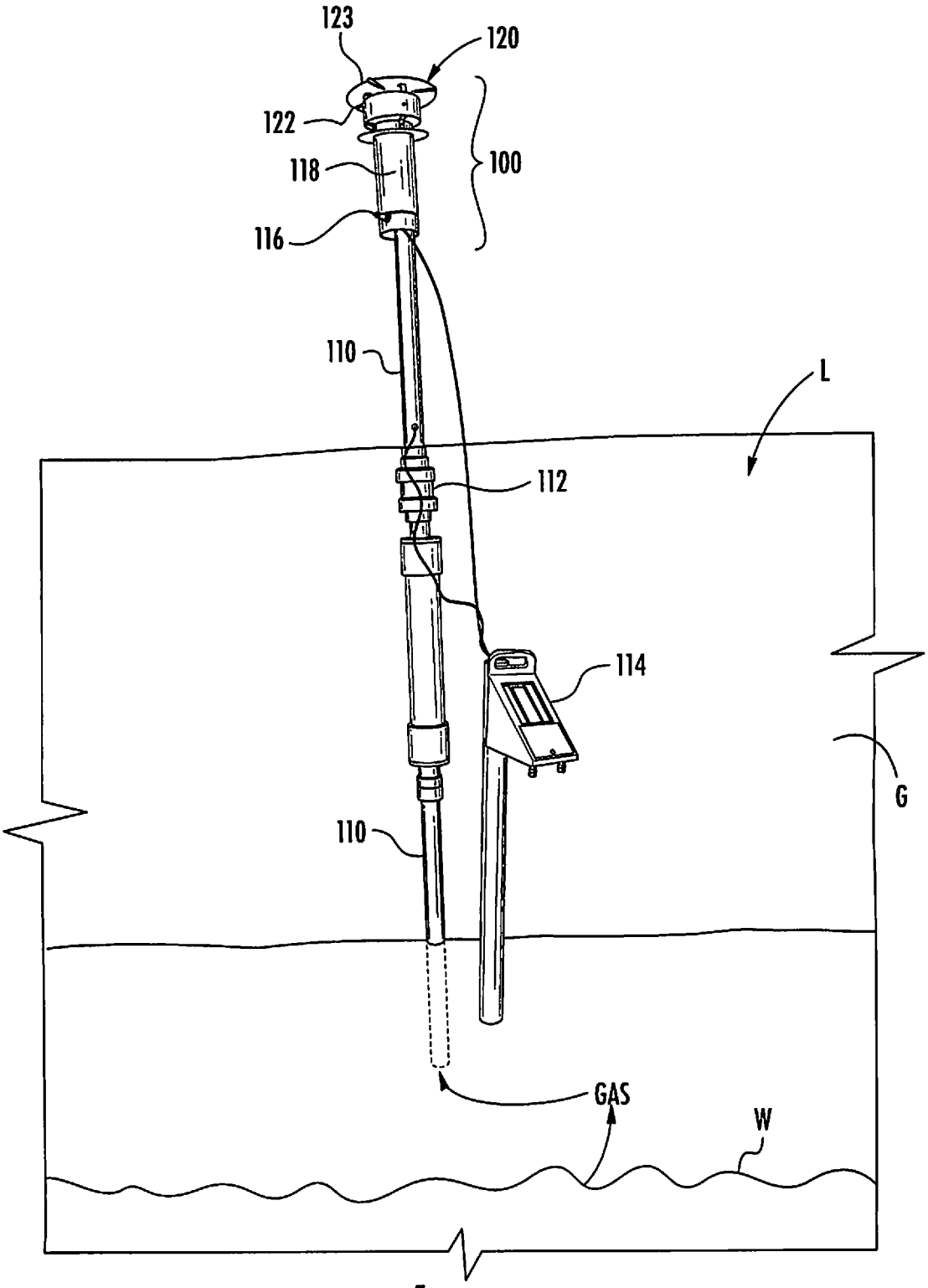
FIG. 1 is a perspective view of an exemplary gas flare apparatus embodiment installed on a gas vent at a C&D landfill.
Figure 3:
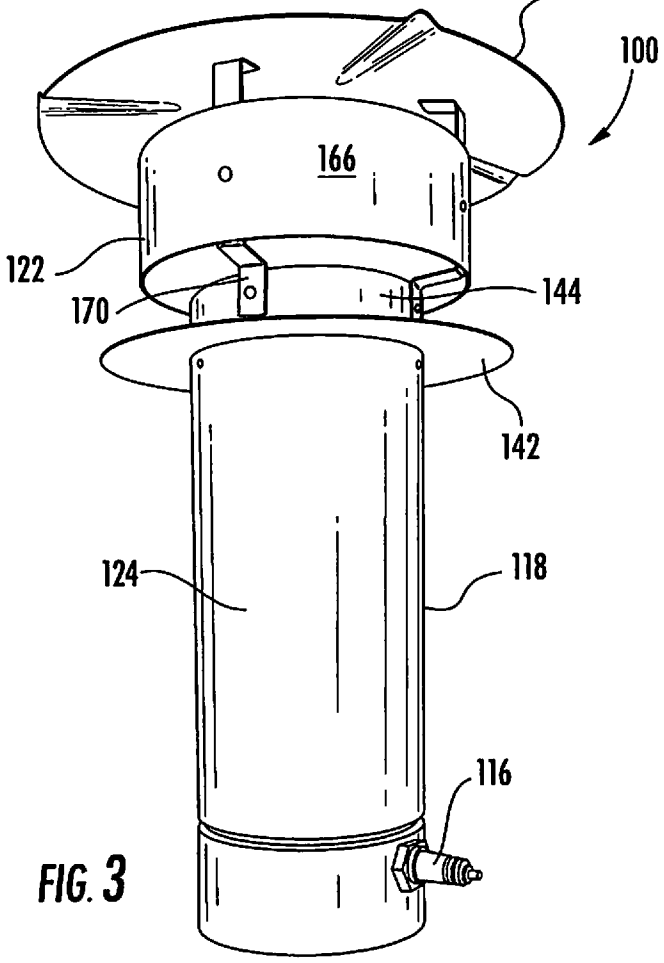
FIG. 3 is a bottom perspective view thereof.
Figure 2:
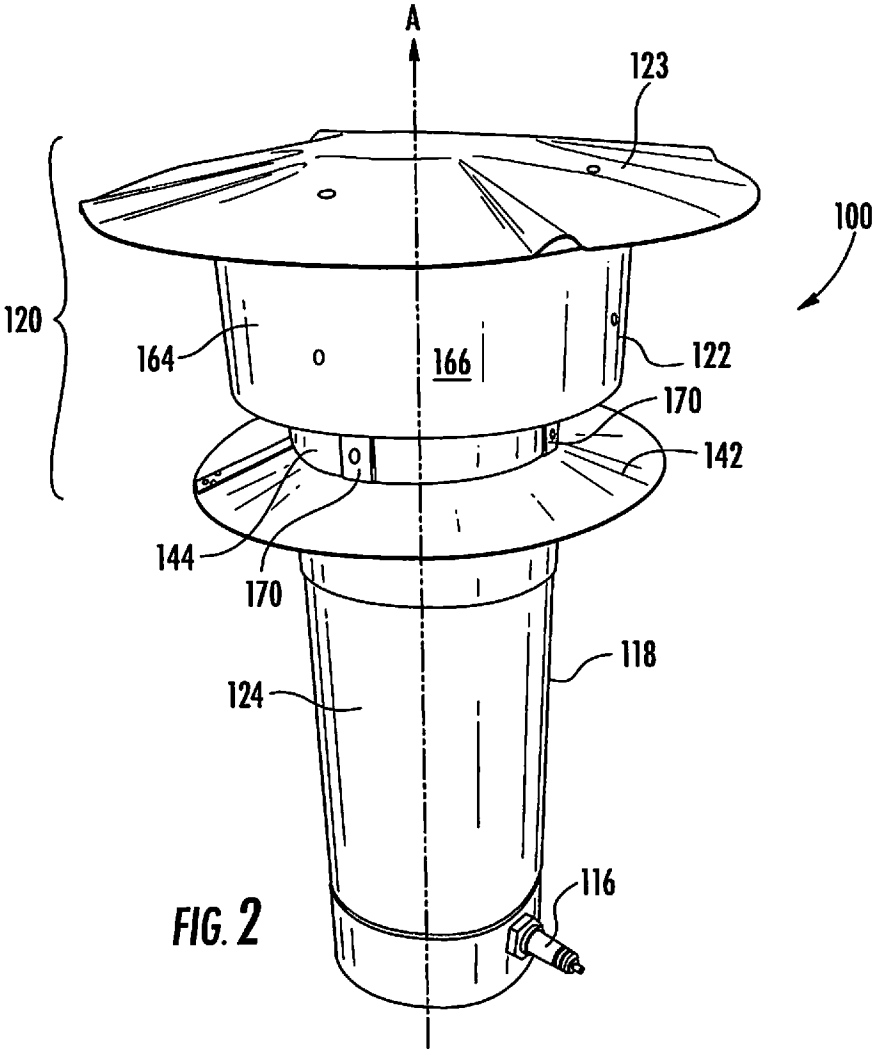
FIG. 2 is a top perspective view of the gas flare apparatus apart from the gas vent.
Figure 4:
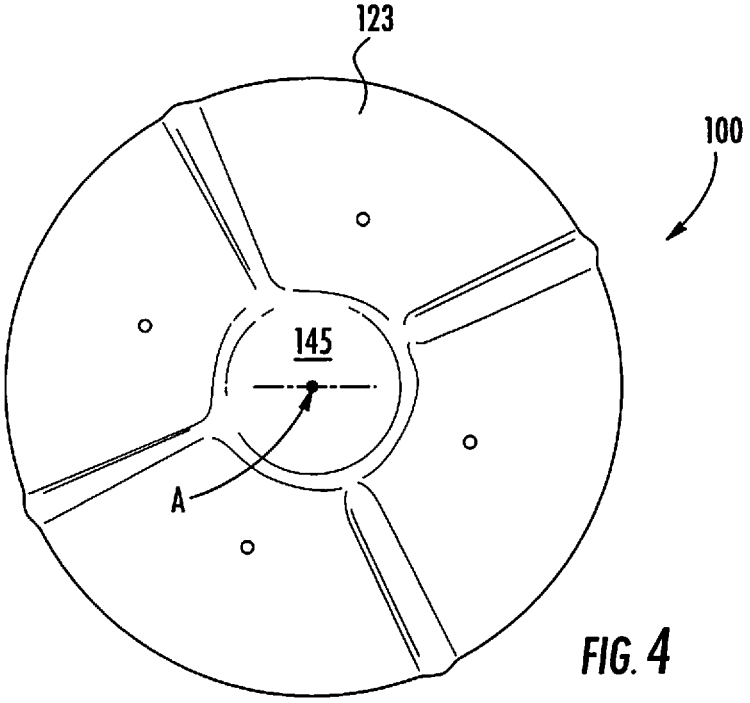
FIG. 4 is a top plan view thereof.
Figure 5:
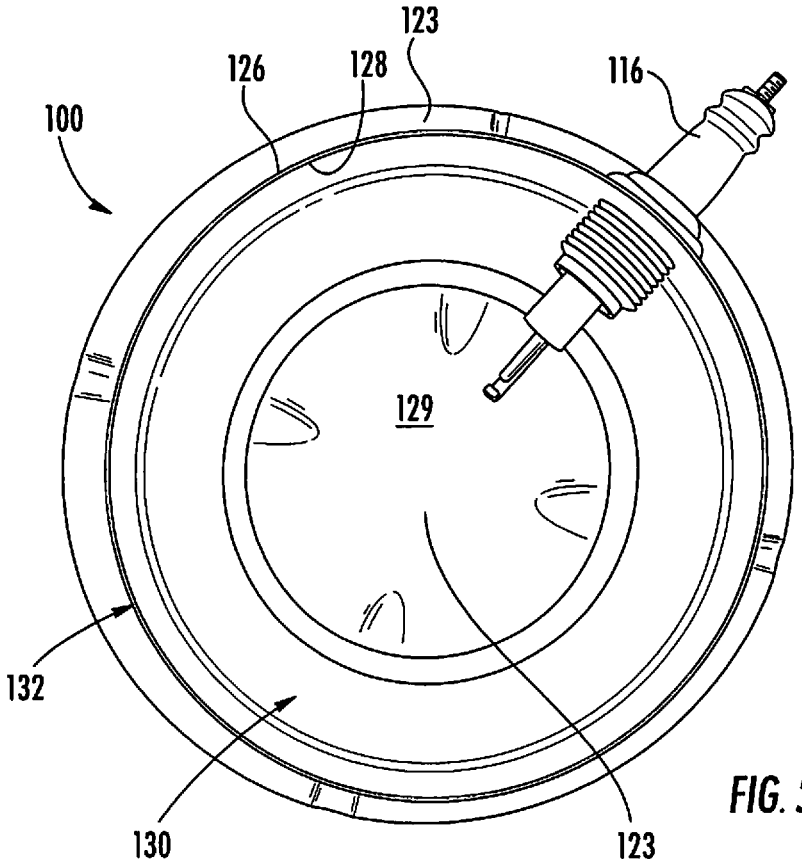
FIG. 5 is a bottom plan view thereof.

Exemplary embodiments are now described by referring to the drawings. Where a particular feature is disclosed in the context of a particular embodiment, that feature can also be used, to the extent possible, in combination with and/or in the context of other embodiments. The apparatus and methods may be embodied in many different forms and should not be construed as limited to only the embodiments described here or shown in the drawings.

Referring to FIG. 1, an example embodiment of the gas flare apparatus 100 is shown installed in a landfill L environment having waste W buried beneath the ground G. The waste W generates combustible gas such as methane, which the gas flare apparatus 100 burns to prevent the gas from entering the atmosphere.

The gas flare apparatus 100 may be used in many different environments other than landfills, but its use is described herein in terms of using it in a construction and demolition waste landfill containing predominantly waste building construction materials such as metal, concrete, drywall, etc. Waste building construction materials do not contain high levels of organic material that generate combustible gas when they decompose. Thus, the gas flare apparatus 100 is specially designed to continue burning combustible gas when the gas flow rate is very low and in windy conditions.

The gas flare apparatus 100 is connected to the underground gas source by a gas flow conduit 110 that is interrupted by a gas flow valve 112 for varying the gas flow. A power supply 114 is connected by wiring to an ignitor 116 attached to a burner tube 118. The gas flare apparatus 100 includes cap 120, including a windshield 122, and a cover plate 123.

The power supply 114 may be solar powered so that battery replacement is not required. Many different types of conventional power supplies may be used in the alternative.

Figure 7:
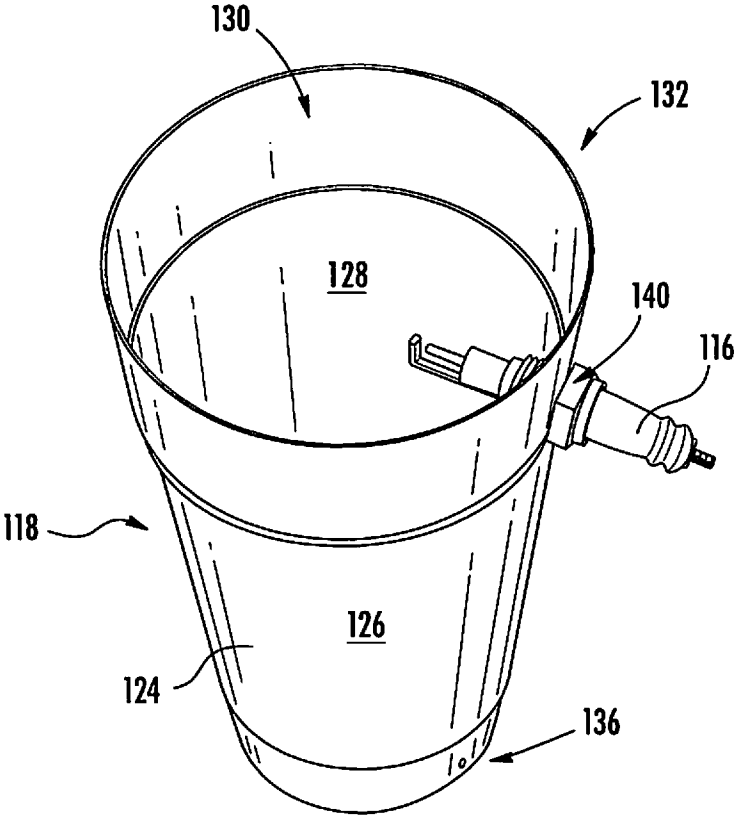
FIG. 7 is a bottom perspective view thereof.
Figure 6:
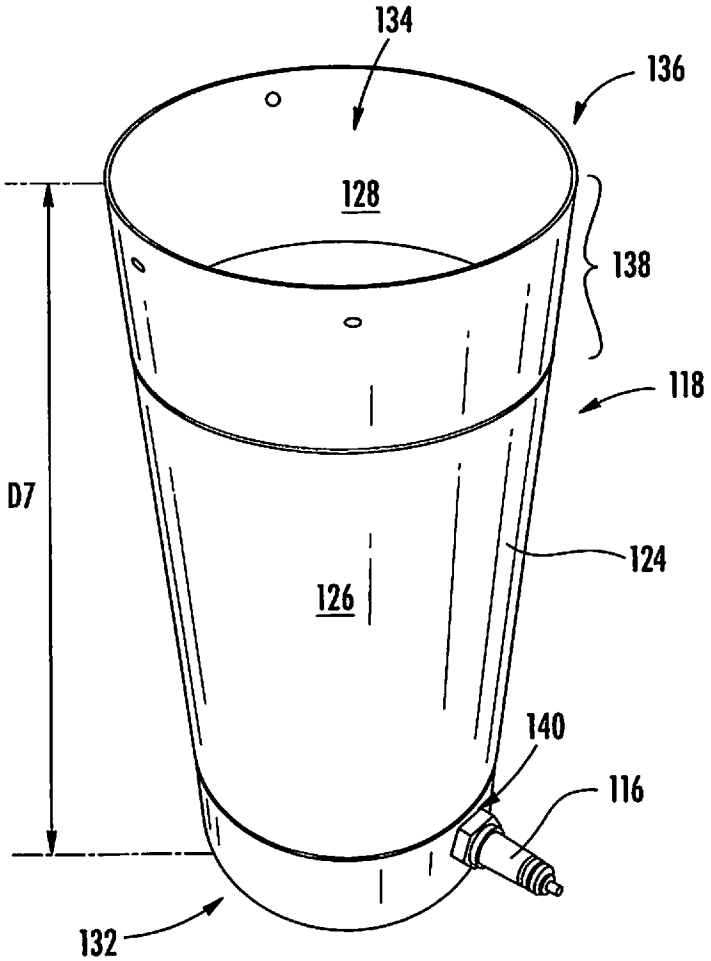
FIG. 6 is a top perspective view of the burner tube.
Figure 8:
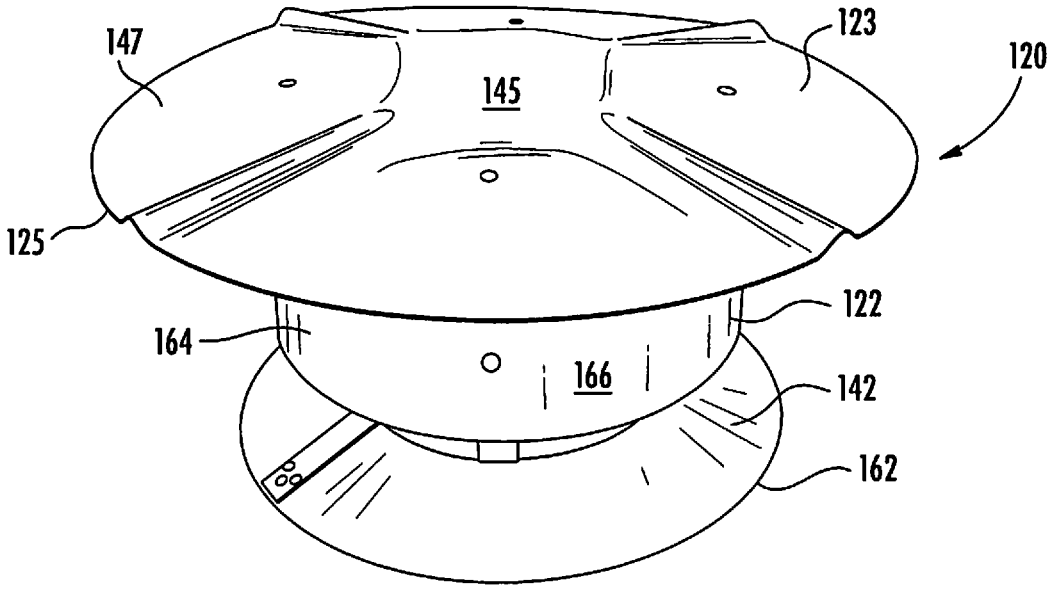
FIG. 8 is a top perspective view of the cap.
Figure 9:
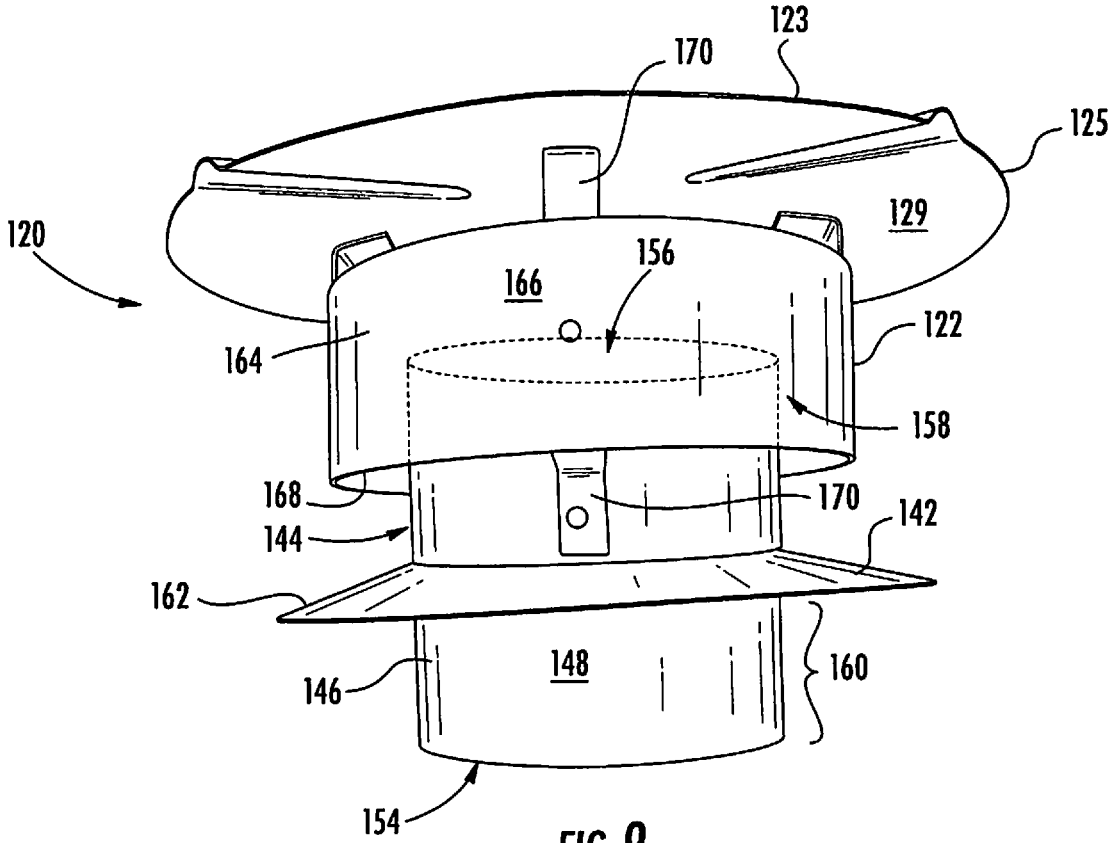
FIG. 9 is a bottom perspective view of the cap.
Figure 10:
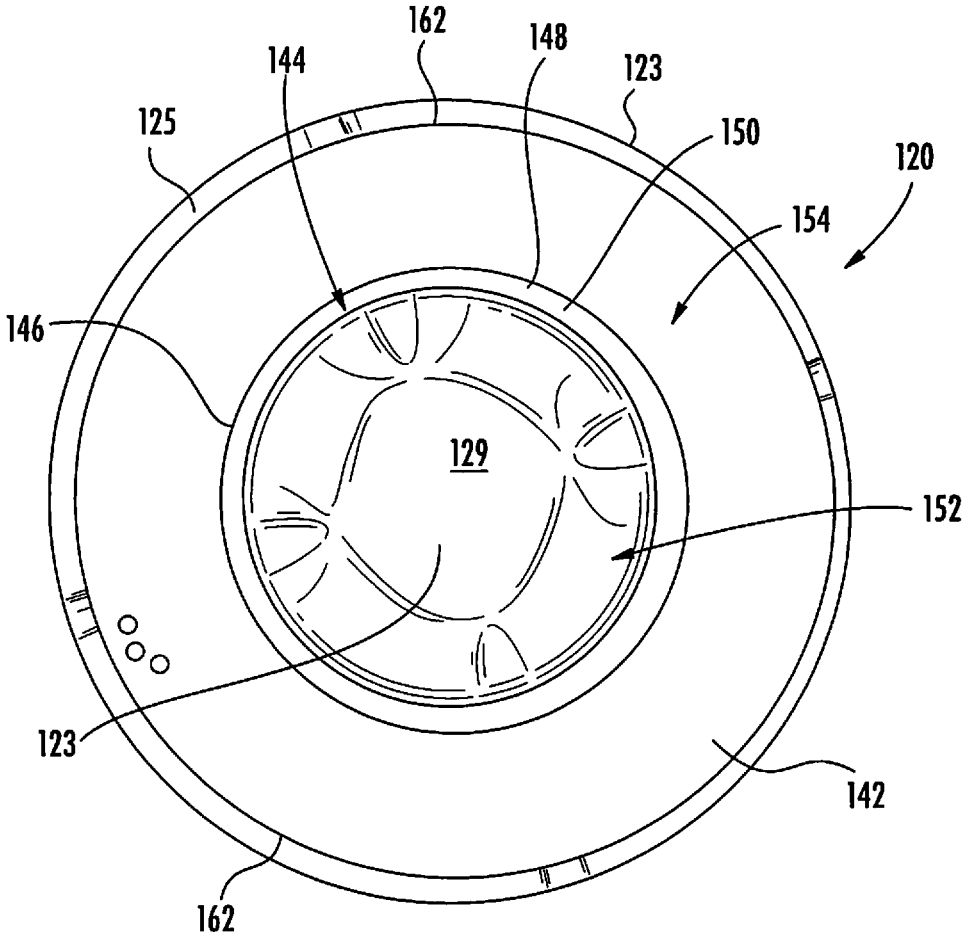
FIG. 10 is a bottom plan view of the cap.
Figure 11:
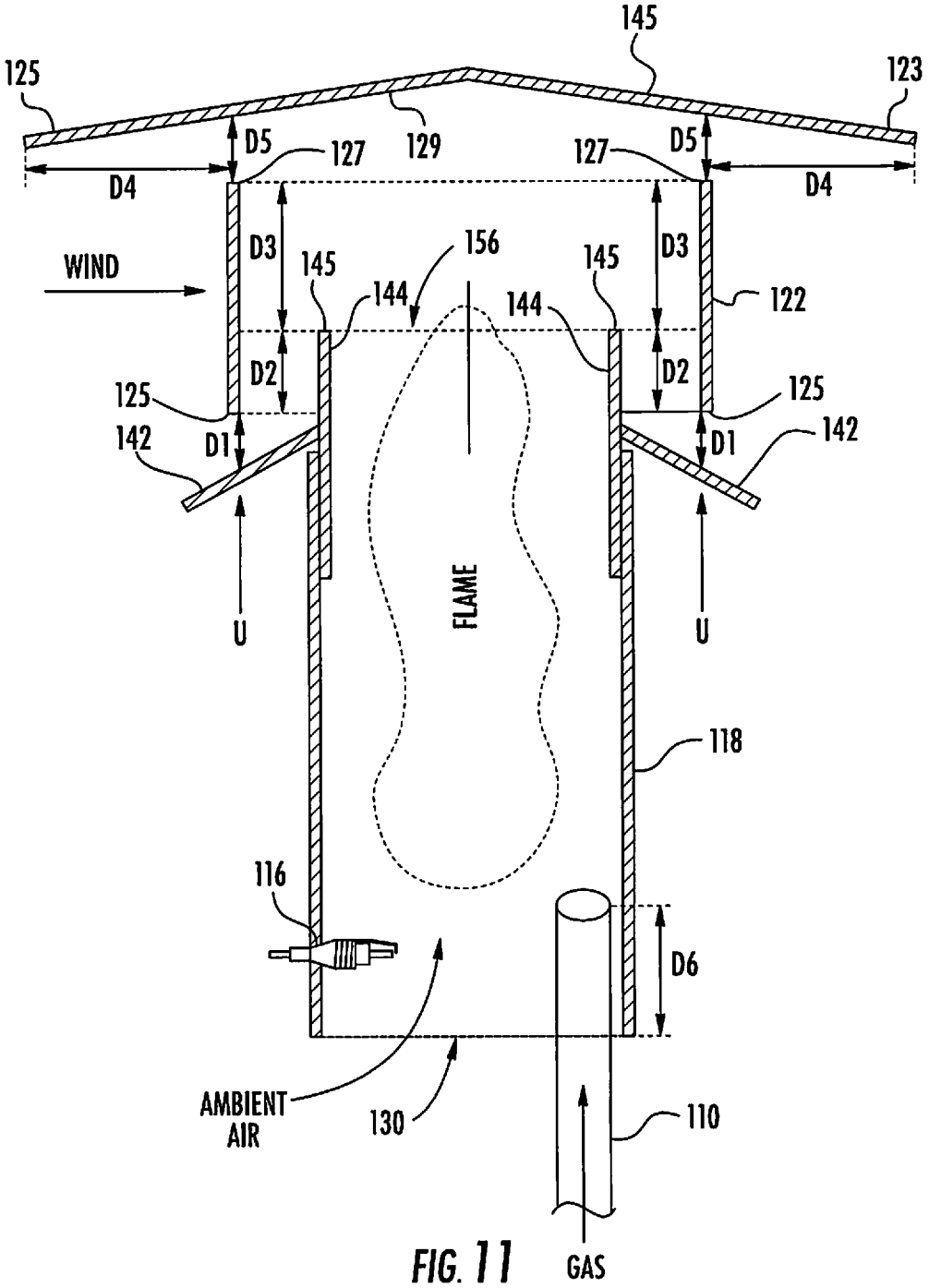
FIG. 11 is a side cutaway view of the gas flare

Additional details of the gas flare apparatus are now described by referring generally to FIGS. 2-11. In FIGS. 2-5, the gas flare apparatus 100 is separated from the gas flow conduit 110. In FIGS. 6 and 7, the burner tube 118 is shown separated from the cap 120. In FIGS. 8 and 9, the cap 120 is shown separated from the burner tube 118.

The gas flare apparatus 100 generally includes the burner tube 118 and the cap 120, which in the embodiment shown are separable from one another, but are not necessarily separable in every embodiment. An axis A passes through the center of the gas flare apparatus 100.

The burner tube 118 includes an elongated tubular body 124 defining an outer wall 126 and an inner wall 128. The diameter of the outer wall 126 defines an outer perimeter of the burner tube 118. The diameter of the inner wall 128 defines an inner diameter of the burner tube 118. The burner tube's elongated tubular body 124 includes a lower opening 130 at a lower end 132 of the burner tube 118 and an upper opening 134 at an upper end 136 of the burner tube 118. The upper end 136 of the burner tube 118 includes a flared section 138 having a slightly larger inner diameter than the rest of the burner tube 118.

The ignitor 116 is mounted to the burner tube 118 by a feedthrough hole 140 formed though the tubular body 124. In the embodiment shown, the ignitor is a sparkplug, but the range of possible ignitors 116 is not limited to sparkplugs. Many other devices may be used to ignite the combustible gas. In this example, the sparkplug generates a spark to ignite the combustible gas in the burner tube 118.

The cap 120 includes the cover plate 123, windshield tube 122, an updraft shield 142, and a sleeve tube 144.

The sleeve tube 144 includes a tubular body 146 that has an axial length less than the axial length of the burner tube 118. The sleeve tube's tubular body 146 defines an outer wall 148 and an inner wall 150. The diameter of the outer wall 148 defines an outer perimeter of the sleeve tube 144. The diameter of the inner wall 150 defines an inner diameter of the sleeve tube 144. The sleeve tube's tubular body 146 includes a lower opening 152 at a lower end 154 of the sleeve tube 144 and an exhaust opening 156 at an upper end 158 of the sleeve tube 144. The exhaust opening 156 is positioned within the windshield tube 122, therefore, it is illustrated by broken lines in FIG. 9.

A lower section 160 of the sleeve tube 144 has a slightly smaller outer diameter than the inner diameter at the upper end of 136 of the burner tube 118. This allows the lower section 160 to fit snugly within the upper end 136 of the burner tube 118. To fit snugly means the lower section 160 may be held within the upper end 136 by friction. The sleeve tube 144 and burner tube 118 may be removably attachable by sliding them together or they may be fastened together. When attached, the sleeve tube 144 is concentric or coaxially aligned with the burner tube 118.

The updraft shield 142 is attached to the sleeve tube 144. The updraft shield 142 is concentric or coaxially aligned with the burner tube 118 and sleeve tube 144 and extends outwardly relative to the burner tube's 118 outer perimeter to an updraft shield outer perimeter 162 having an outer diameter that circumscribes the sleeve tube 144.

The windshield tube 122 includes a windshield tube tubular body 164 defined by an outer wall 166 having an outside diameter and an inner wall 168 having an inner diameter. The axial length of the windshield tube 122 is less than the axial length of the sleeve tube 144. The windshield tube 122 is mounted to the sleeve tube 144 via a plurality of mounting brackets 170 fastened to the sleeve tube 144 and windshield tube 122 with fasteners such as rivets, screws, or the like.

The cover plate 123 includes a top surface 145 and a bottom surface 129 bounded on an outer perimeter 147 thereof by a cover plate rim 125 defining a diameter of the cover plate 123. The cover plate is mounted to the windshield tube 122 via a plurality of mounting brackets 170 fastened to the cover plate 123 and windshield tube 122 with fasteners such as rivets, screws, or the like.

Various features of the gas flare apparatus' 100 construction are designed to prevent the combustible gas flame from being blown out by the wind, which is a major problem when the gas flow rate is low and the flame is not very robust. This is now explained by referring to FIG. 11.

The combustible gas enters the burner tube 118 via the gas conduit 110 and mixes with ambient air that enters the burner tube through the lower opening 130. The ignitor 116 ignites the gas to form a flame.

The updraft shield 142 substantially prevents updrafts U from entering the lower opening of the windshield tube 144. According the updraft shield 142 has a frustoconical shape and an outer diameter that is larger than the outer diameter of the windshield tube 122. The top surface 143 of the updraft shield 142 and bottom rim 125 of the windshield tube 122 are spaced apart by distance D1. D1 may be 0.5 inches to 2.5 inches, 0.5 inches to 2 inches, 0.5 inches to 1.75 inches, or 1 inch to 1.75 inches.

The exhaust opening 156 is positioned within the windshield tube 122 so that the windshield tube substantially dampens lateral wind from blowing across the exhaust opening 156. The distance D2 from the lower rim 125 of the windshield tube 122 to the upper rim 145 of the sleeve tube 144 may be 0.5 inches to 2.5 inches, 0.5 inches to 2 inches, 0.5 inches to 1.5 inches, or 0.5 inches to 1 inch. The distance D3 from the upper rim 145 of the sleeve tube 144 to the upper rim 127 of the windshield tube 122 may be 0.5 inches to 2.5 inches, 0.5 inches to 2 inches, 0.5 inches to 1.75 inches, 0.5 inches to 1.5 inches, or 1 inch to 1.75 inches.

The cover plate 123 substantially prevents rain or other falling debris from falling into the burner tube 118. The distance D4 between the outer rim 125 of the cover plate 123 and the outer wall 164 of the windshield tube 122 may be 0.5 inches to 3 inches, 0.5 inches to 2.5 inches, 0.5 inches to 2 inches, 1 inch to 3 inches, 1 inch to 2.5 inches, or 1 inch to 2 inches.

The distance D5 between the bottom surface 129 of the cover plate 123 and the upper rim 127 of the windshield 122 may be 0.2 inches to 2 inches, 0.2 inches to 1.5 inches, 0.2 inches to 1 inch, 0.5 inches to 2 inches, 0.5 inches to 1.5 inches, 0.5 inches to 1 inch, or 0.75 inches to 1 inch.

The distance D6 corresponding to the length of the gas conduit 110 that is within the burner tube 118 may be 1.5 inches to 6 inches, 1.5 inches to 5 inches, 2 inches to 6 inches, 2 inches to 5 inches, or about 4 inches.

The axial length D7 (see FIG. 6) of the burner tube 118 may be 8 inches to 16 inches, 8 inches to 14 inches, 10 inches to 14 inches, or about 12 inches. This provides a suitable mixing chamber for the gas/air mixture that is not significantly affected by normal wind conditions and helps the flame stay ignited.

Because the amount of combustible gas venting from a C&D landfill is low relative to a typical landfill, the flame in the flare is more susceptible to wind conditions. The constructions of the gas flare apparatus creates a combustion chamber within the burner tube 118 that is substantially insulated from the wind yet still open enough to take in ambient air and to allow exhaust to exit.

The gas flare apparatus 100 may be made of heat-tolerant materials, such as metals, including stainless steel, for example. In a particular example, the gas flare apparatus 100 may be made of stainless steel sheet metal that is about 1/32 inches thick. Such a construction is lightweight. Other examples may be made of different materials with different thicknesses.

Although the tubular structures of the gas flare apparatus 100 are shown in the drawings as being cylindrical, it is not necessary for them to be cylindrical in every example. The tubular structures may have any other tubular shape, such as square, triangular, rectangular, etc.

The apparatus and methods are not limited to the details described in connection with these example embodiments. There are numerous variations and modification of the apparatus and methods that may made without departing from the scope of what is claimed.

That which is claimed is:

1. A gas flare apparatus comprising:

a burner tube that receives combustible gas and includes (a) a burner tube outer perimeter defined by a burner tube outer diameter and (b) a burner tube inner perimeter defined by a burner tube inner diameter;

an igniter on the burner tube;

an updraft shield concentric with the burner tube and extending outwardly relative to the burner tube outer perimeter to an updraft shield outer perimeter;

a windshield tube concentric with the burner tube and having a windshield tube inner diameter that is larger than the burner tube outer diameter, the windshield tube being positioned above the updraft shield; and a cover plate spaced apart from and covering an upper opening of the windshield tube.

2. The gas flare apparatus of claim 1, further comprising a sleeve tube removably attached to the burner tube, wherein the windshield tube and cover plate are attached to the sleeve tube when the sleeve tube is not attached to the burner tube.

3. The gas flare apparatus of claim 2, wherein the sleeve tube includes an exhaust opening at an upper end thereof and the exhaust opening is positioned within the windshield tube.

4. The gas flare apparatus of claim 1, further comprising a sleeve tube having a sleeve tube outer diameter that is smaller than the burner tube inner diameter, wherein the sleeve tube fits snugly within the burner tube inner diameter and the windshield tube and cover plate are attached to the sleeve tube.

5. The gas flare apparatus of claim 1, wherein a bottom side of the cover plate is spaced apart from the upper opening of the windshield tube by a distance of between 0.3 inches to 2 inches.

6. The gas flare apparatus of claim 1, wherein the windshield tube inner diameter is 0.5 inches to 1.5 inches larger than the burner tube outer diameter.

7. A method of combusting landfill gas, the method comprising:

operating a gas flare apparatus positioned over a gas flow conduit that extends into a landfill storing decomposing waste that generates combustible gas, the gas flare apparatus comprising:

a burner tube that receives the combustible gas and includes (a) a burner tube outer perimeter defined by a burner tube outer diameter, (b) a burner tube inner perimeter defined by a burner tube inner diameter, and (c) an open bottom adapted to allow ambient air to flow into the burner tube;

an igniter on the burner tube;

an updraft shield concentric with the burner tube and extending outwardly relative to the burner tube outer perimeter to an updraft shield outer perimeter;

a wind shield tube concentric with the burner tube and having a windshield tube inner diameter that is larger than the burner tube outer diameter, the windshield tube being positioned above the updraft shield; and a cover plate spaced apart from and covering an upper opening of the windshield tube.

8. The method of claim 7, wherein the decomposing waste is predominantly building construction materials.

9. The method of claim 7, wherein the gas flare apparatus further comprises a sleeve tube removably attached to the burner tube, wherein the windshield tube and cover plate are attached to the sleeve tube when the sleeve tube is not attached to the burner tube.

10. The method of claim 9, wherein the sleeve tube includes an exhaust opening at an upper end thereof and the exhaust opening is positioned within the windshield tube.

11. The method of claim 7, wherein the gas flare apparatus further comprises a sleeve tube having a sleeve tube outer diameter that is smaller than the burner tube inner diameter, wherein the sleeve tube fits snugly within the burner tube inner diameter and the windshield tube and cover plate are attached to the sleeve tube.

12. The method of claim 7, wherein a bottom side of the cover plate is spaced apart from the upper opening of the windshield tube by a distance of between 0.3 inches to 2 inches.

13. The method of claim 7, wherein the windshield tube inner diameter is 0.5 inches to 1.5 inches larger than the burner tube outer diameter.

14. A method of constructing a gas flare, the method comprising:

attaching a cap to a burner tube that receives combustible gas and includes (a) a burner tube outer perimeter defined by a burner tube outer diameter, (b) a burner tube inner perimeter defined by a burner tube inner diameter, and (c) an open bottom through which ambient air flows into the burner tube, the cap including a sleeve tube attachable to the burner tube, the sleeve tube having attached thereto: (a) a windshield tube concentric with the burner tube and having a windshield tube inner diameter that is larger than the burner tube outer diameter and (b) a cover plate spaced apart from and covering an upper opening of the windshield tube; and inserting through the open bottom a gas flow conduit that delivers gas to be combusted into the burner tube.

15. The method of claim 14, wherein the sleeve tube includes an exhaust opening at an upper end thereof and the exhaust opening is positioned within the windshield tube.

16. The method of claim 14, wherein the sleeve tube has a sleeve tube outer diameter that is smaller than the burner tube inner diameter and the sleeve tube fits snugly within the burner tube inner diameter when the sleeve tube is attached to the burner tube.

17. The method of claim 14, wherein a bottom side of the cover plate is spaced apart from the upper opening of the windshield tube by a distance of between 0.3 inches to 2 inches.

18. The method of claim 14, wherein the windshield tube inner diameter is 0.5 inches to 1.5 inches larger than the burner tube outer diameter.

* * * * *